US009111496B2

(12) United States Patent
Ito

(10) Patent No.: US 9,111,496 B2
(45) Date of Patent: Aug. 18, 2015

(54) ELECTRO-OPTIC DEVICE AND ELECTRONIC APPARATUS WITH A CONTROL SIGNAL INCLUDING A PRECHARGE PERIOD

(75) Inventor: Akihiko Ito, Tatsuno-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 157 days.

(21) Appl. No.: 13/207,374

(22) Filed: Aug. 10, 2011

(65) Prior Publication Data

US 2012/0038692 A1 Feb. 16, 2012

(30) Foreign Application Priority Data

Aug. 11, 2010 (JP) ..... 2010-180111

(51) Int. Cl.
*G09G 3/36* (2006.01)
*G09G 3/20* (2006.01)

(52) U.S. Cl.
CPC .. *G09G 3/36* (2013.01); *G09G 3/20* (2013.01); *G09G 2310/0251* (2013.01); *G09G 2310/0297* (2013.01); *G09G 2320/0252* (2013.01)

(58) Field of Classification Search
CPC ..... G09G 3/3648; G09G 2310/0248
USPC ..... 345/691
See application file for complete search history.

(56) References Cited

U.S. PATENT DOCUMENTS 5,430,460 A * 7/1995 Takabatake et al. ..... 345/96
5,510,807 A 4/1996 Lee et al.
5,526,013 A * 6/1996 Ono et al. ..... 345/94
2002/0196220 A1* 12/2002 Sato et al. ..... 345/87
2003/0174153 A1* 9/2003 Koyama ..... 345/690
2005/0041488 A1 2/2005 Ito et al.
2005/0052890 A1* 3/2005 Morita ..... 365/87
2005/0078078 A1* 4/2005 Morita ..... 345/100
2005/0104829 A1* 5/2005 Aoki ..... 345/89
2005/0156820 A1* 7/2005 Aoki ..... 345/58
2006/0087488 A1* 4/2006 Ito ..... 345/103
2006/0114204 A1* 6/2006 Sato et al. ..... 345/87
2006/0279492 A1* 12/2006 Chen ..... 345/77
2006/0284815 A1* 12/2006 Kwon et al. ..... 345/98
2006/0290644 A1* 12/2006 Kim ..... 345/100
2007/0075960 A1* 4/2007 Ito ..... 345/98

(Continued)

FOREIGN PATENT DOCUMENTS

JP 2004-045967 A 2/2004
JP 2005-043418 A 2/2005

(Continued)

*Primary Examiner* — Claire X Pappas
*Assistant Examiner* — Robert Stone
(74) *Attorney, Agent, or Firm* — Maschoff Brennan

(57) ABSTRACT

A signal supply circuit supplies, to a control line, a control signal which is set so as to have a precharge potential during a precharge period before start of a writing period and which is set so as to have a gray scale potential corresponding to a designated gray scale of each pixel in a time division manner during the writing period. A plurality of switches controls connection between the signal lines and the control line. A control circuit controls the plurality of switches so as to be concurrently turned on during a precharge period and controls the plurality of switches so as to be turned on sequentially during a plurality of unit periods of the writing period. The control circuit sets an initial unit period after elapse of the precharge period among the plurality of unit periods so as to be longer than the other unit periods.

8 Claims, 7 Drawing Sheets

(56) References Cited

U.S. PATENT DOCUMENTS

| | | | | |
|---|---|---|---|---|
| 2007/0115240 | A1* | 5/2007 | Tanaka et al. | 345/98 |
| 2008/0024404 | A1* | 1/2008 | Tanaka et al. | 345/87 |
| 2009/0040159 | A1* | 2/2009 | Morita | 345/92 |
| 2009/0122035 | A1 | 5/2009 | Ito | |
| 2009/0179835 | A1* | 7/2009 | Ito | 345/76 |
| 2010/0097367 | A1* | 4/2010 | Kitayama et al. | 345/213 |
| 2010/0128011 | A1* | 5/2010 | Ito | 345/209 |

FOREIGN PATENT DOCUMENTS

| | | | |
|---|---|---|---|
| JP | 2006-259224 | A | 9/2006 |
| JP | 2009-116247 | A | 5/2009 |
| JP | 2009-134055 | A | 6/2009 |

* cited by examiner

ELECTRO-OPTIC DEVICE AND ELECTRONIC APPARATUS WITH A CONTROL SIGNAL INCLUDING A PRECHARGE PERIOD

BACKGROUND

1. Technical Field

The present invention relates to a technique for displaying an image using an electro-optic element such as a liquid crystal element.

2. Related Art

Hitherto, there has been suggested an electro-optic device in which pixel circuits are arranged in a matrix form so as to correspond to intersections of a plurality of scanning lines and a plurality of signal lines, respectively. JP-A-2009-116247 discloses a configuration in which a plurality of signal lines is divided into a plurality of sets (hereinafter, referred to as "wiring groups") in units of a predetermined number, a predetermined precharge potential is concurrently supplied to the signal lines of each set, and a gray scale potential corresponding to a designated gray scale of each pixel circuit is supplied to the respective signal lines of each wiring group in a time division manner during each writing period.

In the configuration disclosed in JP-A-2009-116247, a case (hereinafter, referred to as "writing shortage") where the potential of the signal line does not completely reach a target gray scale potential from the precharge potential may occur. When a time length is sufficiently ensured during each writing period, the writing shortage is resolved. However, in order to realize a double-speed driving operation for preventing blur in a moving image, realize stereoscopic vision by displaying a parallax image in a time division manner, and realize high precision of a display image, it is necessary to supply the gray scale potential to each pixel circuit at high speed. Therefore, it is difficult to ensure a sufficient time length of the writing time. Moreover, when a driving circuit with high driving performance is used, the potential of the signal line can reach the target gray scale potential in a short time. However, a problem may arise in that a circuit size or power consumption increases.

SUMMARY

An advantage of some aspects of the invention is that it provides a technique for preventing writing shortage of a gray scale potential for each pixel circuit, while reducing a circuit size or power consumption.

According to an aspect of the invention, there is provided an electro-optic device including: a plurality of pixel circuits which is disposed in correspondence with intersections of a plurality of scanning lines and a plurality of signal lines and which displays gray scales corresponding to potentials of the signal lines when the scanning lines are selected; a scanning line driving circuit which selects the plurality of scanning lines sequentially during respective select periods including a writing period; a signal supply circuit which supplies, to a control line, a control signal which is set so as to have a precharge potential during a precharge period before start of the writing period and which is set so as to have a gray scale potential corresponding to a designated gray scale of each pixel circuit in a time division manner during the writing period; a plurality of switches which controls connection between the plurality of signals and the control signal; and a control circuit which controls the plurality of switches so as to be concurrently turned on during the precharge period and controls the plurality of switches so as to be turned on sequentially during a plurality of unit periods of the writing period. The control circuit sets an initial unit (for example, a unit period U[1]) period after elapse of the precharge period among the plurality of unit periods so as to have a time length (for example, a time length ta) longer than that of the other unit periods.

With such a configuration, the unit period immediately after the precharge period is set to have the longer time length. Therefore, even when there is a large difference between the precharge potential and the gray scale potential, it is possible to reliably vary the potential of the signal line from the precharge potential to the gray scale potential (that is, it is possible to suppress the writing shortage). Further, since it is not necessary to excessively enhance the driving performance of the signal supply circuit or the plurality of switches, it is possible to obtain the advantage of suppressing writing shortage while reducing the circuit size or power consumption.

According to the above aspect of the invention, the signal supply circuit may set the precharge potential of the control signal as a first polarity potential with respect to a reference potential, set the gray scale potential of the control signal as the first polarity potential during the writing period of a first select period (for example, each select period H of a vertical scanning period V1), and set the gray scale potential of the control signal as a reverse polarity potential to the first polarity potential during the writing period of a second select period (each select period H of a vertical scanning period V2). The control circuit may set the plurality of unit periods so as to have the same time length (for example, a time length tb) during the writing period of the first select period, whereas the initial unit period among the plurality of unit periods may be set so as to have a time length (for example, a time length ta) longer than the time length of the other unit periods during the writing period of the second select period. With such a configuration, when the potential of the signal line is varied from the precharge potential to the gray scale potential over the reference potential, (that is, when the variation of potential in the signal lines is large) the writing shortage is suppressed by setting the initial unit period so as to have the longer time length. When the precharge potential and the gray scale potential have the same polarity with respect to the reference potential, for example, it is possible to prevent display unevenness caused due to a difference between the time lengths of the unit periods, by setting the plurality of unit periods so as to have the same time length.

According to another aspect of the invention, there is provided an electro-optic device in which a plurality of signal lines is divided into a plurality of wiring groups in units of the predetermined number of signal lines and a gray scale potential is supplied to each of the wiring groups in a time division manner. The electro-optic device includes: the plurality of pixel circuits which is disposed in correspondence with intersections of a plurality of scanning lines and a plurality of signal lines and which displays gray scales corresponding to potentials of the signal lines when the scanning lines are selected; a scanning line driving circuit which selects the plurality of scanning lines sequentially during respective select periods including a writing period; a signal supply circuit supplies, to a control line corresponding to each of wiring groups into which the plurality of signal lines is divided, a control signal which is set so as to have a precharge potential during a precharge period before start of the writing period and which is set so as to have a gray scale potential corresponding to a designated gray scale of each pixel circuit in a time division manner during the writing period; a plurality of distribution circuits which corresponds to the wiring groups, respectively, and which includes a plurality of switches controlling connection between the respective signals of the wiring group and the control line corresponding to the wiring group; and a control circuit which controls the plurality of switches of each distribution circuit so as to be concurrently turned on during the precharge period and controls the plurality of switches so as to be turned on sequentially during the plurality of unit periods of the writing period. The control circuit sets an initial unit period after elapse of the precharge period among the plurality of unit periods so as to be longer than the other unit periods.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
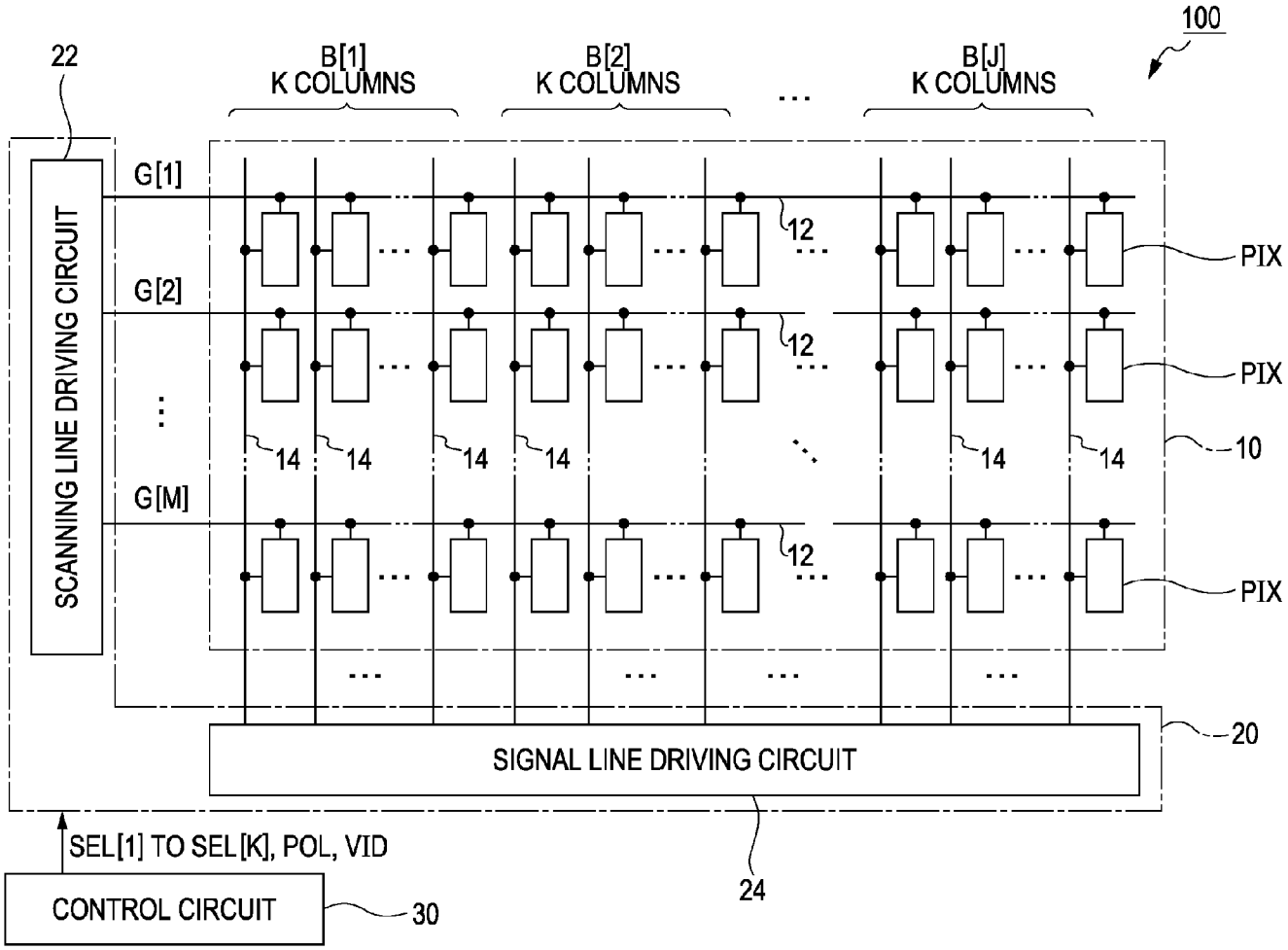
FIG. 1 is a block diagram illustrating an electro-optic device according to a first embodiment of the invention.

FIG. 1 is a block diagram illustrating an electro-optic device 100 according to a first embodiment of the invention. The electro-optic device 100 is a liquid crystal device that is mounted as a display device displaying an image on various electronic apparatuses. As shown in FIG. 1, the electric-optic device 100 includes a pixel section 10 in which a plurality of pixel circuits PIX is arranged in a planar surface, a driving circuit 20 which drives the respective pixel circuits PIX, and a control circuit 30 which controls the driving circuit 20. The driving circuit 20 includes a scanning line driving circuit 22 and a signal line driving circuit 24.

In the pixel section 10, M (where M is a natural number) scanning lines 12 and N (where N is a natural number) signal lines 14 intersecting each other are formed. In the pixel section 10, the N signal lines 14 are divided into J wiring groups (blocks) B[1] to B[J] in units of K (where K is a natural number of 2 or more) signal lines adjacent to each other (where J=N/K). The plurality of pixel circuits PIX is disposed so as to correspond to intersections of the scanning lines 12 and the signal lines 14 and is arranged in a matrix form of M rows vertically by N columns horizontally.

Figure 2:
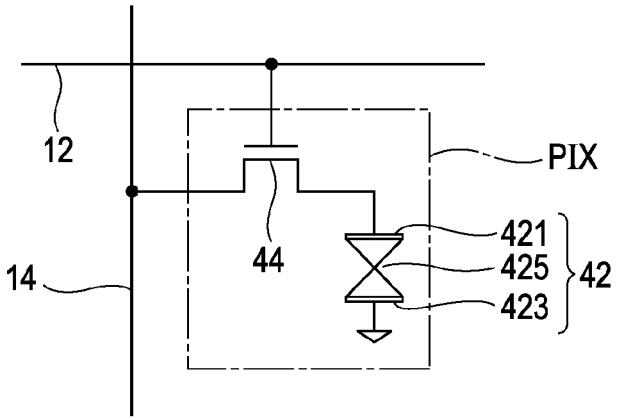
FIG. 2 is a circuit diagram illustrating a pixel circuit.

FIG. 2 is a circuit diagram illustrating each pixel circuit PIX. As shown in FIG. 2, each pixel circuit PIX includes a liquid crystal element 42 and a select switch 44. The liquid crystal element 42 is an electro-optic element that includes a pixel electrode 421 and a common electrode 423 facing each other and includes liquid crystal 425 disposed between both the electrodes. The transmittance of the liquid crystal 425 is varied in accordance with an application voltage applied between the pixel electrode 421 and the common electrode 423. For facilitating the following description, it is assumed that the application voltage to the liquid crystal element 42 has a positive polarity when the potential of the pixel electrode 421 is higher than that of the common electrode 423, whereas the application voltage has a negative polarity when the potential of the pixel electrode 421 is lower than that of the common electrode 423.

The select switch 44 is configured by an N channel type thin film transistor of which a gate is connected to the scanning line 12 and the select switch 44 is disposed between the liquid element 42 (the pixel electrode 421) and the signal line 14 and controls electric connection (conduction/non-conduction) between the liquid element 42 and the signal line 14. Accordingly, the pixel circuit PIX (the liquid crystal element 42) displays a gray scale corresponding to the potential (gray scale potential VG described below) of the signal line 14 when the select switch 44 is controlled to be turned on. An auxiliary capacitor or the like connected to the liquid crystal element 42 in parallel is not illustrated.

Figure 3:
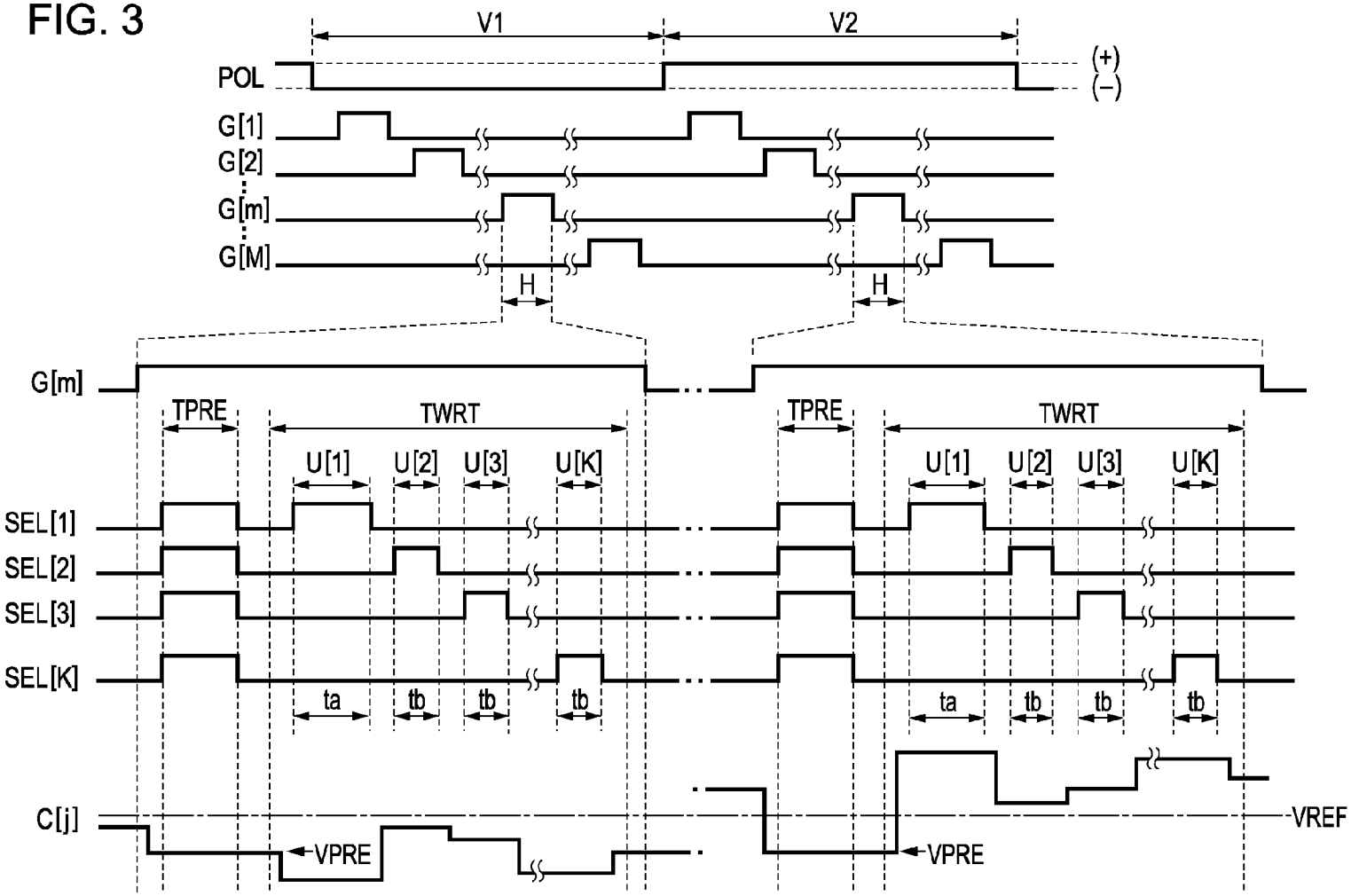
FIG. 3 is a diagram for explaining an operation of the electro-optic device.

The control circuit 30 in FIG. 1 controls the driving circuit 20 by outputting various signals including a synchronization signal. For example, the control circuit 30 supplies an image signal VID, which is used to designate the gray scale of each pixel circuit PIX in a time division manner, to the signal line driving circuit 24. Further, select signals SEL[1] to SEL[K] of K systems corresponding to the number of the signal lines 14 in each wiring group B[j] (where j=1 to J) or polarity signals POL used to designate the polarity of the application voltage of the liquid crystal elements 42 are supplied from the control circuit 30 to the signal line driving circuit 24. As shown in FIG. 3, the control circuit 30 generates the polarity signal POL so that the polarity of the application voltage to the liquid crystal element 42 is reversed during each vertical scanning period V (V1, V2) (frame reversal). Here, a period of the polarity reversal is arbitrarily changed.

The scanning driving circuit 22 in FIG. 1 sequentially selects the M scanning lines 12 by supplying the scanning signals G[1] to G[M] to the scanning lines 12, respectively. As shown in FIG. 3, the scanning signal G[m] supplied to the m-th row scanning line 12 is set with a high level (which is a potential for selection of the scanning line 12) during the m-th select period H among M select periods H (horizontal scanning period) of each vertical scanning period V. When the scanning line driving circuit 22 selects the m-th scanning line 12, the select switches 44 of the N pixel circuits PIX of the m-th scanning line 12 are turned on.

Figure 4:
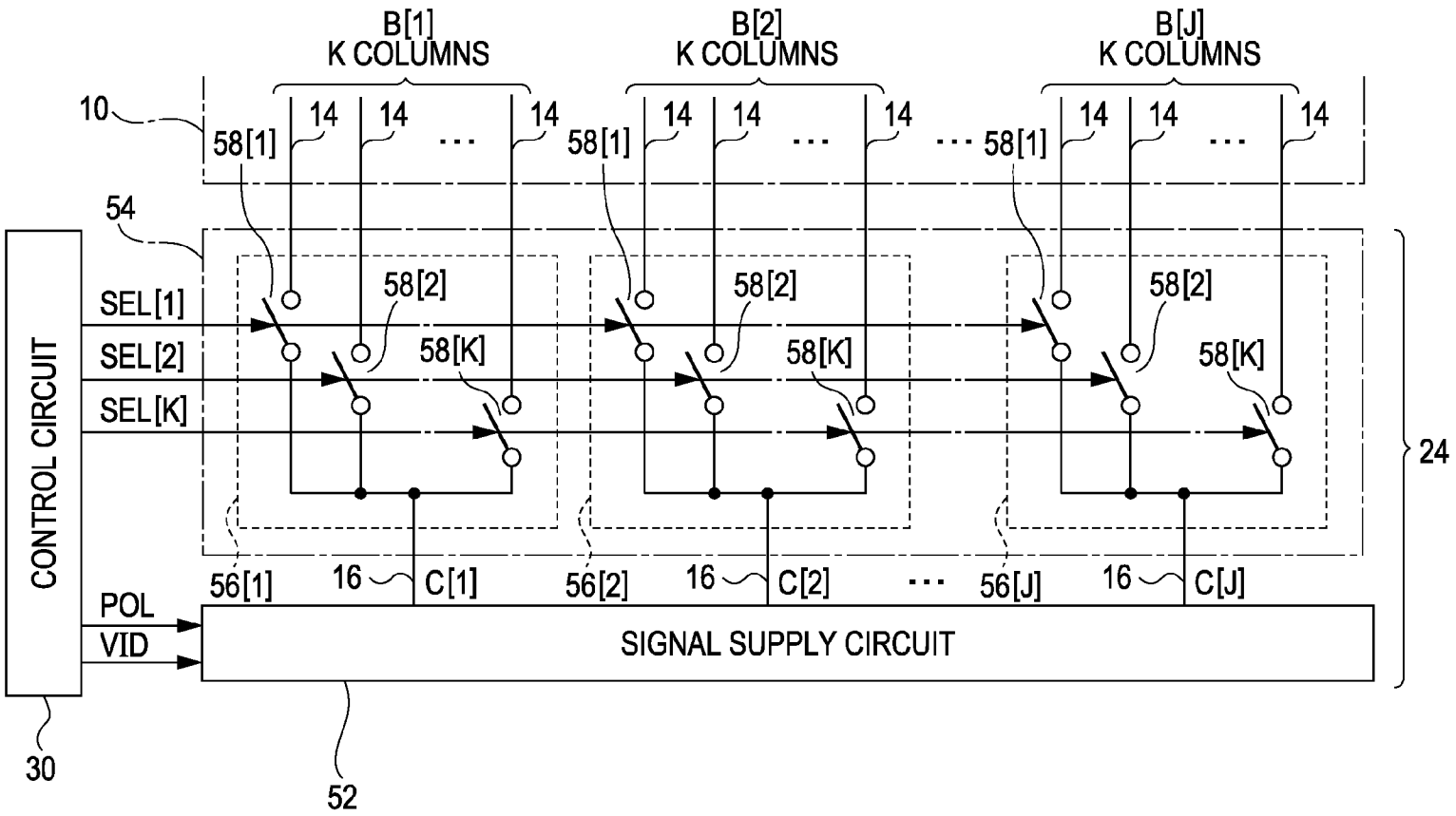
FIG. 4 is a block diagram illustrating a signal line driving circuit.

The signal line driving circuit 24 in FIG. 1 controls the respective potentials of the N signal lines 14 in synchronization with the selection of the scanning lines 12 by the scanning line driving circuit 22. FIG. 4 is a block diagram illustrating the signal line driving circuit 24. As shown in FIG. 4, the signal line driving circuit 24 includes a signal supply circuit 52 and a signal distribution circuit 54. The signal supply circuit 52 and the signal distribution circuit 54 are connected to each other by J control lines 16 corresponding to the different wiring groups B[j]. The signal supply circuit 52 is mounted in the form of an integrated circuit (chip), and the scanning line driving circuit 22 and the signal distribution circuit 54 includes the pixel circuits PIX and thin film transistors formed on the surface of a substrate. Here, the mounted form of the scanning line driving circuit 22 and the signal line driving circuit 24 is arbitrarily changed.

The signal supply circuit 52 in FIG. 4 supplies control signals C[1] to C[J] of J systems corresponding to the different wiring groups B[j] to the control lines 16, respectively. As shown in FIG. 3, each select period H in which the scanning driving circuit 22 selects the scanning lines 12 includes a precharge period TPRE and a writing period TWRT. The signal supply circuit 52 sets control signals C[1] to C[J] in the precharge period TPRE of each select period H so as to have a predetermined precharge potential VPRE. The precharge potential VPRE is set as a negative polarity potential with respect to a predetermined reference potential VREF (for example, a potential centered in the amplitude of the control signal C[j]).

The signal supply circuit 52 sets the control signal C[j], in a time division manner, with the gray scale potentials VG corresponding to the designated gray scales of the K pixel circuits PIX in correspondence with the intersection of the m-th scanning line 12 and the K signal lines 14 of the wiring group B[j] during the writing period TWRT of the select period H in which the m-th scanning line 12 is selected. The designated gray scale of each pixel circuit PIX is defined by the image signal VID supplied from the control circuit 30. The polarity of the gray scale potential VG with respect to the reference potential VREF is set in accordance with the polarity signal POL. That is, as shown in FIG. 3, the signal supply circuit 52 sets the gray scale potentials VG corresponding to the designated gray scales within a negative polarity range with respect to the reference potential VREF during the writing period TWRT of each select period H within the vertical scanning period V1 in which the polarity signal POL has the negative polarity (−). Further, the signal supply circuit 52 sets the gray scale potentials VG corresponding to the designated gray scales within a positive polarity range with respect to the reference potential VREF during the writing period TWRT of each select period H within the vertical scanning period V2 in which the polarity signal POL has the positive polarity (+).

As shown in FIG. 4, the signal distribution circuit 54 includes J distribution circuits 56[1] to 56[J] corresponding to the different wiring groups B[j]. The j-th distribution circuit 56[j] includes circuits (demultiplexer) which distribute the control signal C[j] supplied to the j-th control line 16 to the K signal lines 14 and are K switches 58[1] to 58[K] corresponding to the different signal lines 14 of the wiring group B[j]. The k-th switch 58[k] of the distribution circuit 56[j] is disposed between the k-th signal line 14 among the K signal lines 14 of the wiring group B[j] and the j-th control line 16 among the J control lines 16 to control electric connection (conduction/non-conduction) therebetween. Each select signal SEL[k] generated by the control circuit 30 is supplied in parallel to the gates of the k-th switches 58[k] (the sum of the J switches 58[k] in the signal distribution circuit 54) in the J distribution circuits 56[1] to 56[J].

As shown in FIG. 3, the control circuit 30 concurrently sets the select signals SEL[1] to SEL[K] of K systems so as to have an active level (potential allowing the switch 58[k] to be turned on) during the precharge period TPRE of each select period H. Accordingly, all of the switches 58[k] in the signal distribution circuit 54 are turned on during the precharge period TPRE of each select period H, and thus the precharge potential VPRE is supplied to the N signal lines 14 (and the pixel electrodes 421 of the respective pixel circuits PIX). Thus, since the potential of the respective signal lines 14 are initialized to the precharge potential VPRE before the supply (before writing) of the gray scale potentials VG to the respective pixel circuits PIX, it is possible to prevent gray scale unevenness (vertical crosstalk) of the display image.

On the other hand, the control circuit 30 sets the select signals SEL[1] to SEL[K] of K systems so as to have the active level during the K unit periods U[1] to U[K] in the writing period TWRT of each select period H. Accordingly, during the unit period U[k] in the select period H in which the m-th scanning line 12 is selected, the k-th switches 58[k] (the sum of the J switches 58[k] in the signal distribution circuit 54) among the K switches 58[1] to 58[K] in the respective distribution circuits 56[1] to 56[J] are turned on, and thus the gray scale potentials VG of the control signal C[j] are supplied to the k-th signal line 14 of each wiring group B[j]. That is, during the writing period TWRT, the gray scale potentials VG are supplied in a time division manner to the K signal lines 14 in the wiring group B[j] of the J wiring groups B[1] to B[J]. During the unit period U[k] in the m-th select period H, the gray scale potentials VG are set in accordance with the gray scale grays of the pixel circuits PIX in correspondence with the intersections of the m-th scanning line 12 and the k-th signal line 14 of the wiring group B[j].

As shown in FIG. 3, the control circuit 30 compares a time length (the pulse width of the select signal SEL[1]) to of the initial unit period U[1] after elapse of the precharge period TPRE among the K unit periods U[1] to U[K] of the writing period TWRT to time length (the pulse widths of the select signals SEL[2] to SEL[K]) tb of the other unit periods U[2] to U[K], and then sets a longer length as the time length. That is, during the unit period U[1] immediately after the precharge period TPRE, the gray scale potentials Vg are supplied to the signal line 14 (the 1st signal line 14 in each wiring group B[j]) for a longer time compared to the other unit periods U[2] to U[K].

As described above, the longer time length ta is ensured for the unit period U[1] immediately after the precharge period TPRE. Therefore, even when there is a large difference between the gray scale potential VG supplied to the 1st signal line 14 of each wiring group B[j] and the precharge potential VPRE, it is possible to reliably vary the potential of the signal line 14 from the precharge potential VPRE to the gray scale potential VG within the unit period U[1] (that is, suppress the writing shortage). On the other hand, since the unit periods U[2] to U[K] are set so as to have the time length tb shorter than that of the unit period U[1], the time length of each writing time TWRT is shortened compared to the case where all of the unit periods U[1] to U[K] are set so as to have the longer time length ta. Accordingly, it is possible to obtain the advantage that the supply of the gray scale potential VG to each pixel circuit PIX (writing operation) can be performed at a high speed. Further, since the writing shortage is suppressed by setting the unit period U[1] so as to have the time length ta, it is not necessary to enhance the driving performance of the signal line driving circuit 24 (the signal distribution circuit 54). Accordingly, the writing shortage is suppressed while the circuit size and the power consumption are reduced.

B. Second Embodiment

Next, a second embodiment of the invention will be described. The same reference numerals are given to the constituent elements having the same operations and functions as those of the first embodiment and the description thereof will not be repeated.

Figure 5:
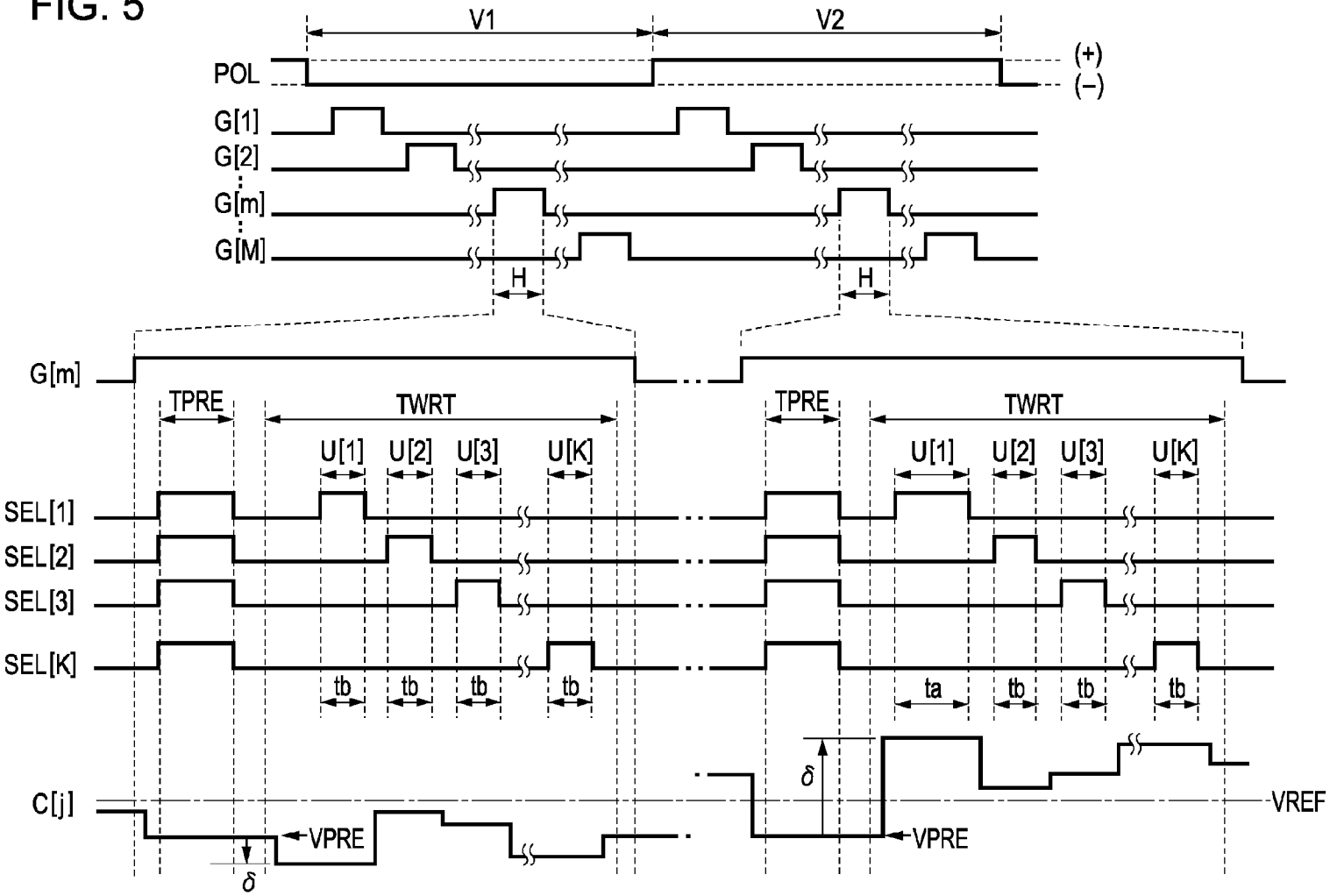
FIG. 5 is a diagram for explaining an operation of an electro-optic device according to a second embodiment.

FIG. 5 is a diagram illustrating an operation of an electro-optic device 100 according to the second embodiment. As shown in FIG. 5, a variation δ (VPRE→VG) in the potential of the signal line 14 after elapse of the precharge period TPRE is considerably lower in a case (the vertical scanning period V2), where the gray scale potential VG and the precharge potential VPRE during the writing period TWRT has a reverse polarity with respect to the reference potential VREF, than in a case (the vertical scanning period V1), where the gray scale potential VG and the precharge potential VPRE during the writing period TWRT has the same polarity with respect to the reference potential VREF. In the second embodiment, as shown in FIG. 5, the precharge potential VPRE is also set as a negative polarity potential with respect to the reference potential VREF, as in the first embodiment. Accordingly, the writing shortage of the gray scale potential VG easily occurs during the vertical scanning period V2 (case where a positive polarity voltage is applied to the liquid crystal elements 42) in which the gray scale potential VG is set as the positive polarity potential with respect to the reference potential VREF. In other words, the writing shortage of the gray scale potential VG does not seemingly appear during the vertical scanning period V1 in which the gray scale potential VG and the precharge potential VPRE are set to have the same polarity.

Accordingly, as in the first embodiment, the initial unit period U[1] of the writing period TWRT of each select period H is set so as to have the time length ta longer than that of the other unit periods U[2] to U[K] during the vertical scanning period V2 in which the polarity signal POL has the positive polarity, whereas all (K) of the unit periods U[1] to U[K] of the writing period TWRT of each select period H are set so as to have the same time length tb during the vertical scanning period V1 in which the polarity signal POL has the negative polarity. The time length of the writing period TWRT is common to the vertical scanning period V1 and the vertical scanning period V2. However, since it is not necessary to set the unit period U[1] so as to have the time length ta during each writing time TWRT (select period H) of the vertical scanning period V1, each writing period TWRT of the vertical scanning period V1 can be set to be shorter than each writing period TWRT of the vertical scanning period V2.

In the second embodiment, it is possible to also obtain the same advantage as that of the first embodiment for the vertical scanning period V2. In the second embodiment, since the K unit periods U[1] to U[K] of each writing period TWRT of the vertical scanning period V1 are set so as to have the same time length tb, for example, it is possible to obtain the advantage of resolving the concern that the display unevenness caused due to the difference in the time length of the unit period U[k] occurs.

C. Modification

The above-described embodiments may be modified in various forms. The specific modifications will be exemplified below. Two or more selected modifications among the modifications described below may be combined appropriately.

(1) Modification 1

The precharge potential VPRE is appropriately modified. For example, the precharge potential VPRE may be set as the positive polarity potential with respect to the reference potential VREF. Alternatively, the precharge potential VPRE may be varied in accordance with the polarity (the polarity signal POL) of the gray scale potential VG (where the precharge potential VPRE is different between the vertical scanning period V1 and the vertical scanning period V2).

(2) Modification 2

In the above-described embodiment, the configuration (that is, the configuration in which the precharge potential VPRE reaches up to the pixel electrodes 421 via the select switch 44 turned on by the selection of the scanning line 12) has hitherto been described in which each select period H includes the precharge period TPRE. However, the precharge potential VPRE may be supplied to each signal line 14 before start of the select period H. (That is, the scanning line 12 is not selected during the precharge period TPRE and the precharge potential VPRE does not reach up to the pixel electrode 421). Since the signal line 14 is initialized so as to have the precharge VPRE in both the configurations, the gray scale unevenness of the display image is suppressed.

(3) Modification 3

The order in which the switches 58[1] to 58[K] are turned on during the writing period TWRT of each select period H may be changed sequentially. For example, JP-A-2004-45967 discloses this configuration. In this configuration, the unit period U[k] set so that the time length ta is not fixed to the unit period U[1] in which the switch 58[1] is turned on, but may be changed frequently. The initial unit period U(k) after elapse of the precharge period TPRE during the writing period TWRT may be set so as to have the longer time length ta irrespective of the order of the selection of the switches 58[1] to 58[K].

(4) Modification 4

The N signal lines 14 may not be divided into the J wiring groups B[1] to B[J]. That is, the invention is applied to even a configuration in which only one wiring group B[j] is used.

(5) Modification 5

The liquid crystal element 42 is just one example of the electro-optic element. The invention may be applied to any electro-optic element including a self-luminous electro-optic element which itself emits light, a non-luminous type electro-optic element (for example, the liquid crystal element 42) which varies transmittance or reflectance of external light, a current-driven type electro-optic element which is driven by supply of current, and a voltage-driven type electro-optic element which is driven by application of an electric field (voltage). For example, the invention is applicable to the electro-optic device 100 using various electro-optic elements such as an organic EL element, an inorganic EL element, an LED (Light Emitting Diode), a field electron emission element (FE (Field-Emission) element), a surface conduction electron emitter (SE element), Ballistic electron Emitting element (BS element), an electrophoretic element, and an electrochromic element. That is, the electro-optic element includes a driven element (generally, a display element of which gray scales are controlled in accordance with a gray scale signal) using an electro-optic material (for example, the liquid crystal 425) of which a gray scale (optical characteristic such as transmittance or luminance) is varied by an electric operation of supplying current or voltage (electric field).

D. Application

Figure 6:
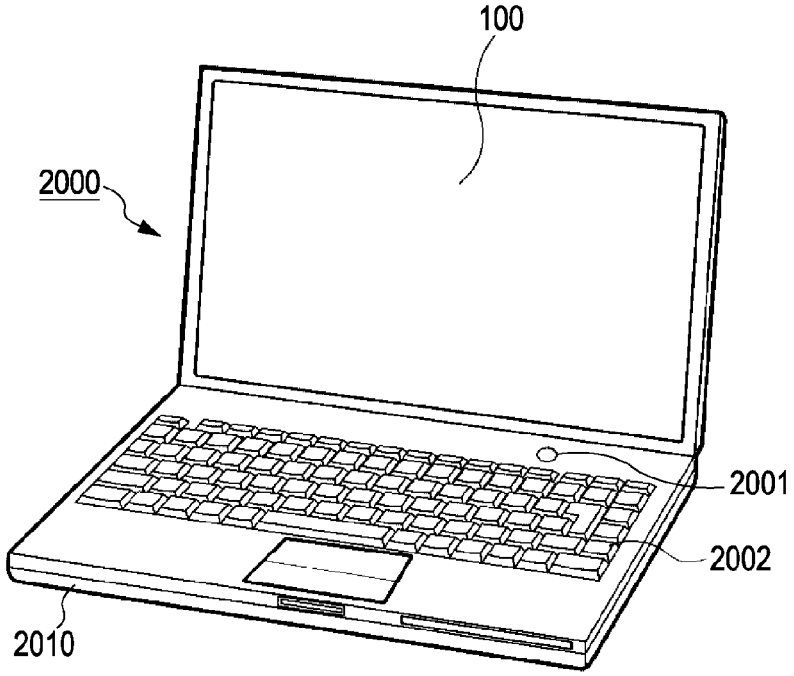
FIG. 6 is a perspective view illustrating an example of an electronic apparatus (personal computer).
Figure 7:
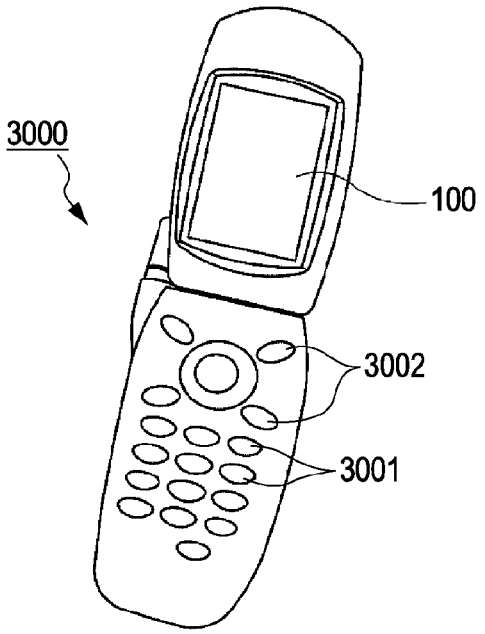
FIG. 7 is a perspective view illustrating an example of an electronic apparatus (cellular phone).
Figure 8:
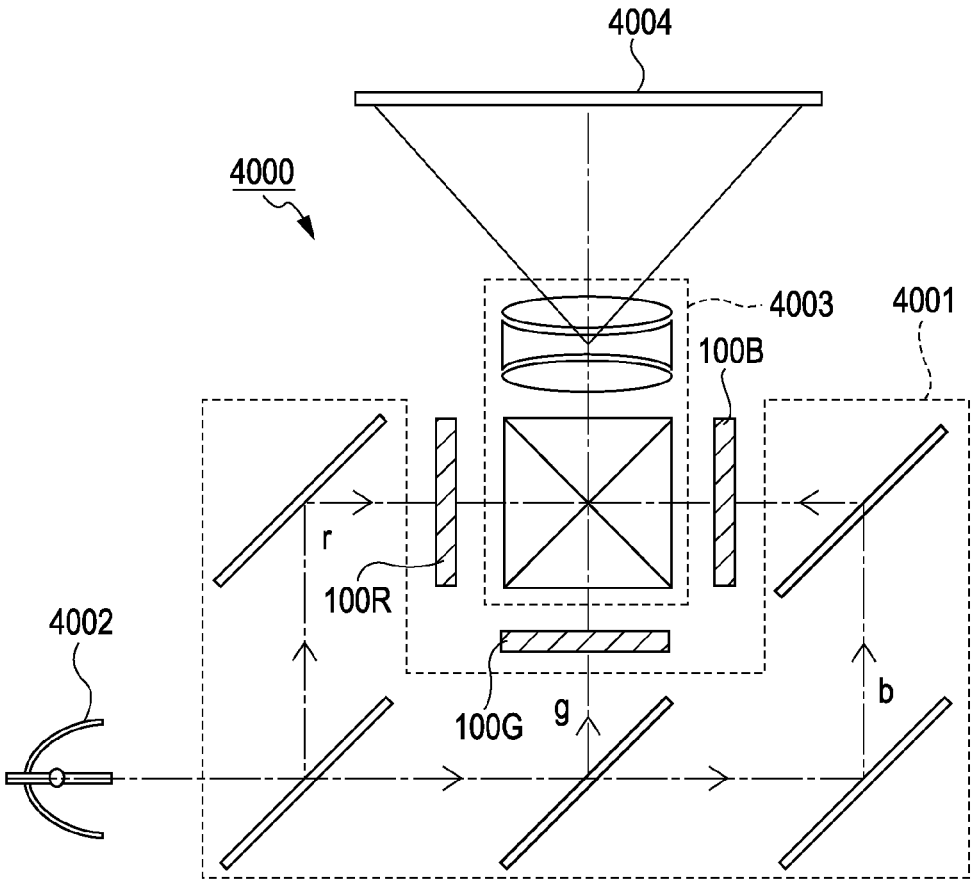
FIG. 8 is a perspective view illustrating an example of an electronic apparatus (projection type display apparatus).

The electro-optic device 100 according to the above-described embodiments can be used in various electronic apparatuses. In FIGS. 6 to 8, specific electronic apparatuses using the electro-optic device 100 are exemplified.

FIG. 6 is a perspective view illustrating a portable personal computer using the electro-optic device 100. A personal computer 2000 includes the electro-optic device 100 displaying various kinds of images, and a main body 2010 including a power switch 2001 and a keyboard 2002.

FIG. 7 is a perspective view illustrating a cellular phone to which the electro-optic device 100 is applied. A cellular phone 3000 includes a plurality of operation buttons 3001, scroll buttons 3002, and the electro-optic device 100 displaying various type of images. By operating the scroll buttons 3002, a screen displayed on the electro-optic device 100 is scrolled.

FIG. 8 is a schematic diagram illustrating a projection type display apparatus (three-plate type projector) 4000 to which the electro-optic device 100 is applied. The projection type display apparatus 4000 includes three electro-optic devices 100 (100R, 100G, and 100B) corresponding to different colors (red, green, and blue). An illumination optical system 4001 supplies a red component r, a green component g, and a blue component b being emitted from an illumination device (light source) 4002 to the electro-optic devices 100R, 100G, and 100B, respectively. Each electro-optic device 100 serves as an optical modulator (light valve) which modulates each monochromatic light supplied from the illumination optical system 4001 in accordance with a display image. A projection optical system 4003 synthesizes the emitted light from the respective electro-optic devices 100 and projects the synthesized light onto a projection surface 4004.

Examples of the electronic apparatus to which the electro-optic device according to the invention is applied include a portable information terminal (PDA: Personal Digital Assistant), a digital still camera, a television, a video camera, a car navigation apparatus, an in-vehicle display apparatus (instrument panel), an electronic pocket book, an electronic paper, a calculator, a word processor, a workstation, a television phone, a POS terminal, a printer, a scanner, a copy machine, a video player, an apparatus with a touch panel, as well as the apparatuses exemplified in FIGS. 6 to 8.

The entire disclosure of Japanese Patent Application No. 2010-180111, filed Aug. 11, 2010 is expressly incorporated by reference herein.

What is claimed is:

1. An electro-optic device comprising:

a plurality of pixels which is disposed in correspondence with intersections of a plurality of scanning lines and a plurality of signal lines and which displays gray scales corresponding to potentials of the signal lines when the scanning lines are selected;

a scanning line driving circuit which selects the plurality of scanning lines sequentially during respective select periods including a writing period;

a signal supply circuit which supplies, to a control line, a control signal which is set so as to have a precharge potential during a precharge period before start of the writing period and which is set so as to have a gray scale potential corresponding to a designated gray scale of each pixel in a time division manner during the writing period;

a plurality of switches which controls connection between the plurality of signals and the control signal; and a control circuit which controls the plurality of switches so as to be concurrently turned on during the precharge period and controls the plurality of switches so as to be turned on sequentially during a plurality of unit periods of the writing period, wherein the control circuit sets an initial unit period of the writing period after elapse of the precharge period among the plurality of unit periods so as to be longer than each of the other unit periods such that the gray scale potential is supplied for a longer period of time in the initial unit period than in each of the other unit periods, wherein the signal supply circuit sets the precharge potential of the control signal as a first polarity potential with respect to a reference potential, sets the gray scale potential of the control signal as the first polarity potential during the writing period of a first select period, and sets the gray scale potential of the control signal as a reverse polarity potential to the first polarity potential during the writing period of a second select period, wherein the initial unit period of the writing period of the second select period is longer than the initial unit period of the writing period of the first select periods.

2. The electro-optic device according to claim 1, wherein control circuit sets the plurality of unit periods so as to have the same time length during the writing period of the first select period, whereas setting the initial unit period of the writing period among the plurality of unit periods so as to have a time length longer than the time length of the other unit periods during the writing period of the second select period.

3. An electronic apparatus comprising the electro-optic device according to claim 1.

4. An electronic apparatus comprising the electro-optic device according to claim 2.

5. An electro-optic device comprising:

a plurality of pixels which is disposed in correspondence with intersections of a plurality of scanning lines and a plurality of signal lines and which displays gray scales corresponding to potentials of the signal lines when the scanning lines are selected;

a scanning line driving circuit which selects the plurality of scanning lines sequentially during respective select periods including a writing period;

a signal supply circuit supplies, to a control line corresponding to each of wiring groups into which the plurality of signal lines is divided, a control signal which is set so as to have a precharge potential during a precharge period before start of the writing period and which is set so as to have a gray scale potential corresponding to a designated gray scale of each pixel in a time division manner during the writing period;

a plurality of distribution circuits which corresponds to the wiring groups, respectively, and which includes a plurality of switches controlling connection between the respective signals of the wiring group and the control line corresponding to the wiring group; and a control circuit which controls the plurality of switches of each distribution circuit so as to be concurrently turned on during the precharge period and controls the plurality of switches so as to be turned on sequentially during the plurality of unit periods of the writing period, wherein the control circuit sets an initial unit period of the writing period after elapse of the precharge period among the plurality of unit periods so as to be longer than the other unit periods such that the gray scale potential is supplied for a longer period of time in the initial unit period than in each of the other unit periods, wherein the signal supply circuit sets the precharge potential of the control signal as a first polarity potential with respect to a reference potential, sets the gray scale potential of the control signal as the first polarity potential during the writing period of a first select period, and sets the gray scale potential of the control signal as a reverse polarity potential to the first polarity potential during the writing period of a second select period, wherein the initial unit period of the writing period of the second select period is longer than the initial unit period of the writing period of the first select periods.

6. An electronic apparatus comprising the electro-optic device according to claim 5.

7. An electro-optic device comprising:

a plurality of pixels which is disposed in correspondence with intersections of a plurality of scanning lines and plurality of signal lines and which displays gray scales corresponding to potentials of the signal lines when the scanning lines are selected;

a scanning line driving circuit which selects periods including a writing period;

a signal supply circuit supplies, to a control line corresponding to each of wiring groups into which the plurality of signal lines is divided, a control signal which is set so as to have gray scale potential corresponding to a designated gray scale of each pixel in a time division manner during the writing period;

a plurality of distribution circuits which corresponds to the wiring groups, respectively, and which includes a plurality of switches controlling connection between the respective signals of the wiring group and the control line corresponding to the wiring group; and a control circuit which controls the plurality of switches so as to be turned on sequentially during the plurality of unit periods of writing period, wherein the control circuit sets an initial unit period of the writing period among the plurality of unit periods so as to be longer than all the other unit periods such that the gray potential is supplied for a longer period of time in the initial unit period than in all the other unit periods, wherein the initial unit period of the writing period of one polarity gray potential with respect to a reference potential has different length to the initial unit period of the writing period of a reverse polarity gray potential to the one polarity gray potential.

8. An electronic apparatus comprising the electro-optic device according to claim 7.

* * * * *